US007159739B2

(12) United States Patent
Fenton et al.

(10) Patent No.: US 7,159,739 B2
(45) Date of Patent: Jan. 9, 2007

(54) DISPENSER FOR DISCRETE GRAVITY-FLOWABLE OBJECTS

(75) Inventors: Scott Fenton, Poughquag, NY (US); Denisa Fenton, Poughquag, NY (US)

(73) Assignee: Humoresque, Inc.

( * ) Notice: Subject to any disclaimer, the term of this patent is extended or adjusted under 35 U.S.C. 154(b) by 197 days.

(21) Appl. No.: 10/706,636

(22) Filed: Nov. 12, 2003

(65) Prior Publication Data

US 2005/0098576 A1 May 12, 2005

(51) Int. Cl.
*B65H 9/00* (2006.01)

(52) U.S. Cl. ..... 221/167; 221/270; 221/276

(58) Field of Classification Search ..... 221/167, 221/270, 276

See application file for complete search history.

(56) References Cited

U.S. PATENT DOCUMENTS

| | | | | |
|---|---|---|---|---|
| 952,208 | A | 4/1907 | Reihing | |
| 1,313,174 | A | 8/1919 | Eisenhardt | |
| 1,547,953 | A | 7/1925 | Palmer | |
| 1,569,637 | A | 1/1926 | Snyder | |
| 1,940,103 | A | 12/1933 | Rosen | |
| 2,256,340 | A | 9/1941 | Gora et al. | |
| 2,479,488 | A | 8/1949 | Goldfarb | |
| 3,660,930 | A | 5/1972 | Indjian | |
| 3,731,851 | A | 5/1973 | Rauh | |
| 3,785,525 | A * | 1/1974 | Handeland | 221/265 |
| 3,998,238 | A * | 12/1976 | Nigro | 221/279 |
| 4,614,283 | A * | 9/1986 | Becker | 221/278 |
| 5,356,035 | A | 10/1994 | Shlopak et al. | |
| 5,385,267 | A | 1/1995 | Diamond et al. | |
| 5,388,723 | A | 2/1995 | Kampmeyer | |
| 5,913,453 | A * | 6/1999 | Coleman et al. | 221/24 |
| 6,129,608 | A | 10/2000 | Prichard et al. | |
| 6,220,479 | B1 * | 4/2001 | Fishman | 221/24 |
| 6,267,639 | B1 * | 7/2001 | Menow et al. | 446/81 |
| 6,299,015 | B1 | 10/2001 | Hasan et al. | |
| 6,471,074 | B1 * | 10/2002 | Coleman et al. | 221/49.1 |
| 6,530,499 | B1 * | 3/2003 | Coleman et al. | 221/24 |
| 6,543,639 | B1 * | 4/2003 | Kovens | 221/24 |
| 6,726,058 | B1 * | 4/2004 | Giraud | 221/267 |
| 6,736,971 | B1 * | 5/2004 | Sale et al. | 210/500.27 |
| 6,918,509 | B1 * | 7/2005 | Baker et al. | 221/266 |

FOREIGN PATENT DOCUMENTS

| | | |
|---|---|---|
| DE | 400 292 | 8/1924 |
| IT | 531 479 | 8/1955 |

* cited by examiner

*Primary Examiner*—Douglas A. Hess
(74) *Attorney, Agent, or Firm*—Kilgannon & Steidl

(57) ABSTRACT

A dispenser for dispensing gravity-flowing objects from a storage area to a receiving station outside the dispenser comprising an upstanding wall portion, a top surface defined by the upstanding wall having a bowl-shaped surface with dual upwardly inclined portions meeting at an apex, an opening extending from the base of the bowl-shaped surface downwardly to the base of the upstanding wall portion, a chute extending from an upper portion of the opening laterally and downwardly to and through the perimeter of the upstanding wall portion, and a plunger disposed in a sliding reciprocating but non-rotational relation within the opening, said plunger having a recess in its side wall that is positioned above the opening in the bowl-like surface when the dispenser is in a non-dispensing position and positioned in registry with the inboard opening of the chute when the dispenser is in a dispensing position. A spring causing the recess in the side wall of the plunger to move from a non-dispensing to a dispensing position is provided.

2 Claims, 5 Drawing Sheets

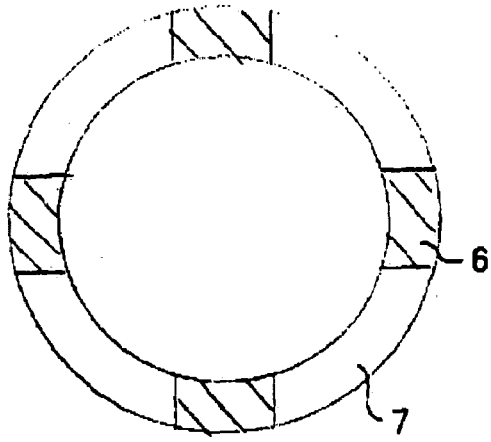
FIG. 1A
FIG. 1
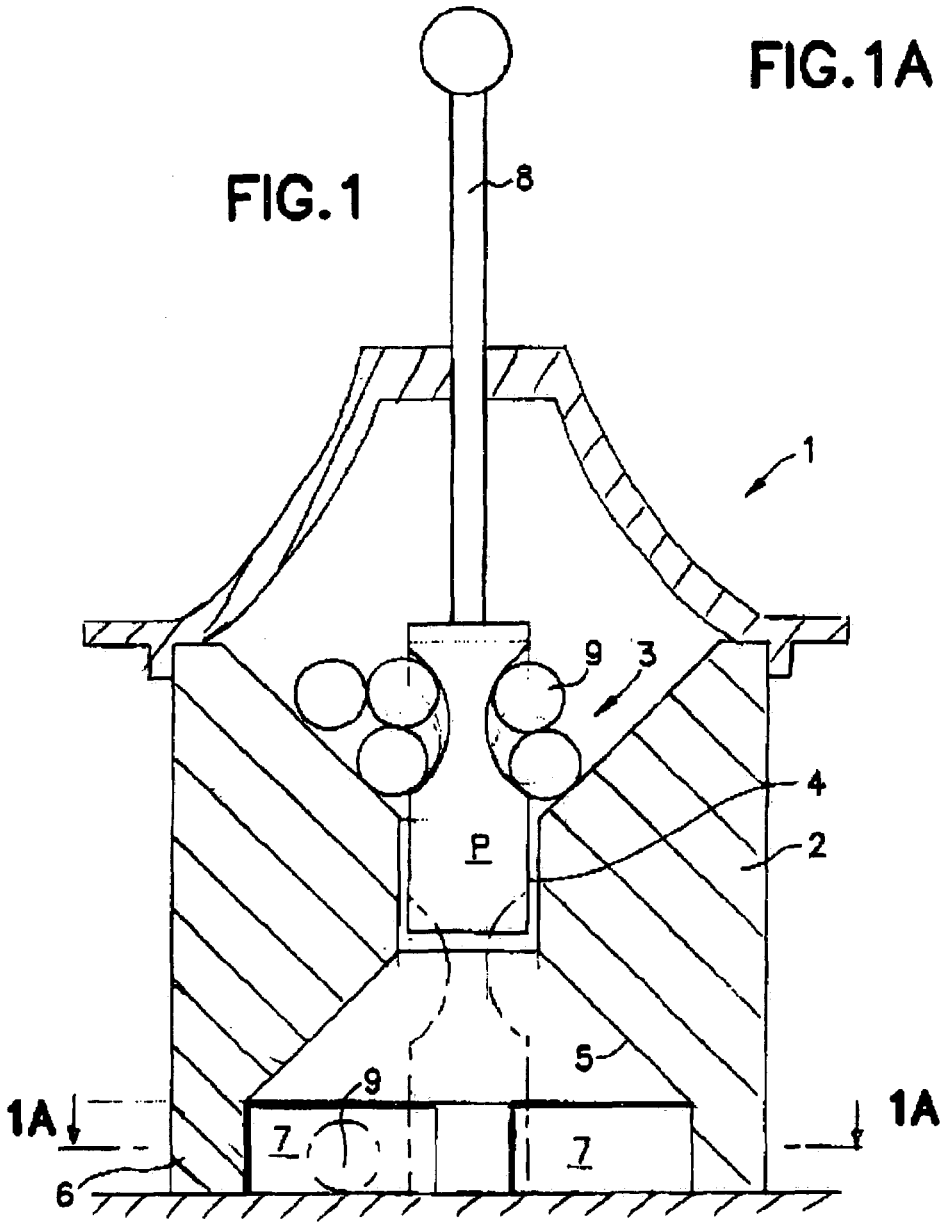

DISPENSER FOR DISCRETE GRAVITY-FLOWABLE OBJECTS

BACKGROUND OF THE INVENTION

1. Field of the Invention

The present invention relates to dispensers for discrete gravity-flowable objects, for example, spherically-shaped candies. Many toy caricatures and figurines are known for use as dolls and dispensers of various types, or a combination of both ornamental dispensers and ornamental toys. When such toy figurines are used as dispensers, various means are employed to enclose materials stored within the bodies or other portions of the toy figurines. In some cases, toy figurines have been used to store and dispense candy portions, as in gum machines and in toy figurines in the forms of dolls and characters.

The construction of various loading and closure devices to enable storage and dispensing of candy portions presents challenges in terms of designing low-cost, easily operable, effective devices which can be easily activated by children and adults.

2. Description of the Prior Art

Candy dispensers having an open and closed position for the dispensing mechanism and utilizing a figurine and, in some cases, having a simulated sound-producing capability are disclosed in U.S. Pat. Nos. 5,356,035; 5,385,267; 6,129,608; 6,267,639; and 6,299,015.

SUMMARY OF THE INVENTION

The dispenser of this invention, in its broadest aspect, comprises an upstanding wall, a storage compartment disposed within the upper portion of the upstanding wall having a funnel-shaped contour, an opening in the storage area extending through the compartment and communicating with the exterior of the upstanding wall portion, and a plunger disposed in a vertically reciprocating relation in the opening, said plunger having a recess in its side wall suitable for receiving the discrete, gravity-flowable objects to be dispensed.

In a more preferred aspect of the invention, the dispenser of this invention comprises an upstanding wall portion defining a perimeter of the dispenser, a top surface defined by the upstanding wall having a downward and inwardly inclined surface, an opening extending from the base of the inclined surface downwardly to an opening of the upstanding wall portion beneath the inclined top surface, a chute extending from an upper portion of the opening laterally and downwardly to and through the perimeter of the upstanding wall portion, and a plunger disposed in a vertically reciprocating, but non-rotational, relation within the opening, said plunger having a recess in its side wall that is positioned above the opening in the bowl-shaped surface when the dispenser is in a non-dispensing position and positioned in registry with inboard opening of the chute when the dispenser is in a dispensing position. The plunger is attached to a means for effecting the reciprocating movement of the plunger within the opening from a non-dispensing position to a dispensing position of the dispenser. Means, such as a spring disposed in the opening beneath the plunger may be provided to move the plunger from a dispensing to a non-dispensing position for the dispenser. To prevent the plunger from rotating within the opening and, thus, deregistering the recess in the plunger and the chute, the shape of the opening may be non-cylindrical and the outer surface of the plunger along its longitudinal axis is in a conforming shape to the opening.

In one embodiment of the invention, the base of the opening has an annular groove or recess configured to receive and stabilize the lower end of a spring used to return the plunger to the non-dispensing position of the dispenser. Further in this embodiment, there is a rod attached to the plunger, said rod extending upwardly through a lid for the upstanding wall portion and accessible for manual gripping and downward movement to activate the dispenser and thereby dispense objects. The lid may have a removable portion for insertion of the product to be dispensed into the bowl-shaped storage zone.

If desired, a figurine such as, for example, a carousel horse, may be disposed atop the lid. In such instance, the rod may extend through a suitably positioned opening in the figurine.

In the above-described embodiment, the upstanding wall defining the perimeter of the dispenser may have a base or tray with a surrounding upstanding curvilinear wall which acts to contain any dispensed product.

BRIEF DESCRIPTION OF THE DRAWINGS

FIG. 1 is a cross-sectional view of a broad embodiment of the dispenser of this invention.

FIG. 1A is a view along the line 1A—1A of FIG. 1.

FIG. 1 illustrates a broad aspect of the invention utilizing a reciprocating plunger to transport the objects to be dispensed from a storage area to an area outside the dispenser. In FIG. 1, the dispenser generally designated as 1 has an upstanding wall 2, a storage area 3 defined by the upstanding wall 2, an opening 4 extending from the storage area 3 to the base 5 of the upstanding wall 2, the base of the upstanding wall 2 having a plurality of posts 6 defining its periphery, the space between the posts 6 providing openings 7 from which the spherical objects 9 can emerge when the handle 8 is depressed to move the plunger P from the position shown in FIG. 1 to the position indicated by the dash lines of FIG. 1.

DETAILED DESCRIPTION OF A PREFERRED EMBODIMENT

Figure 2:
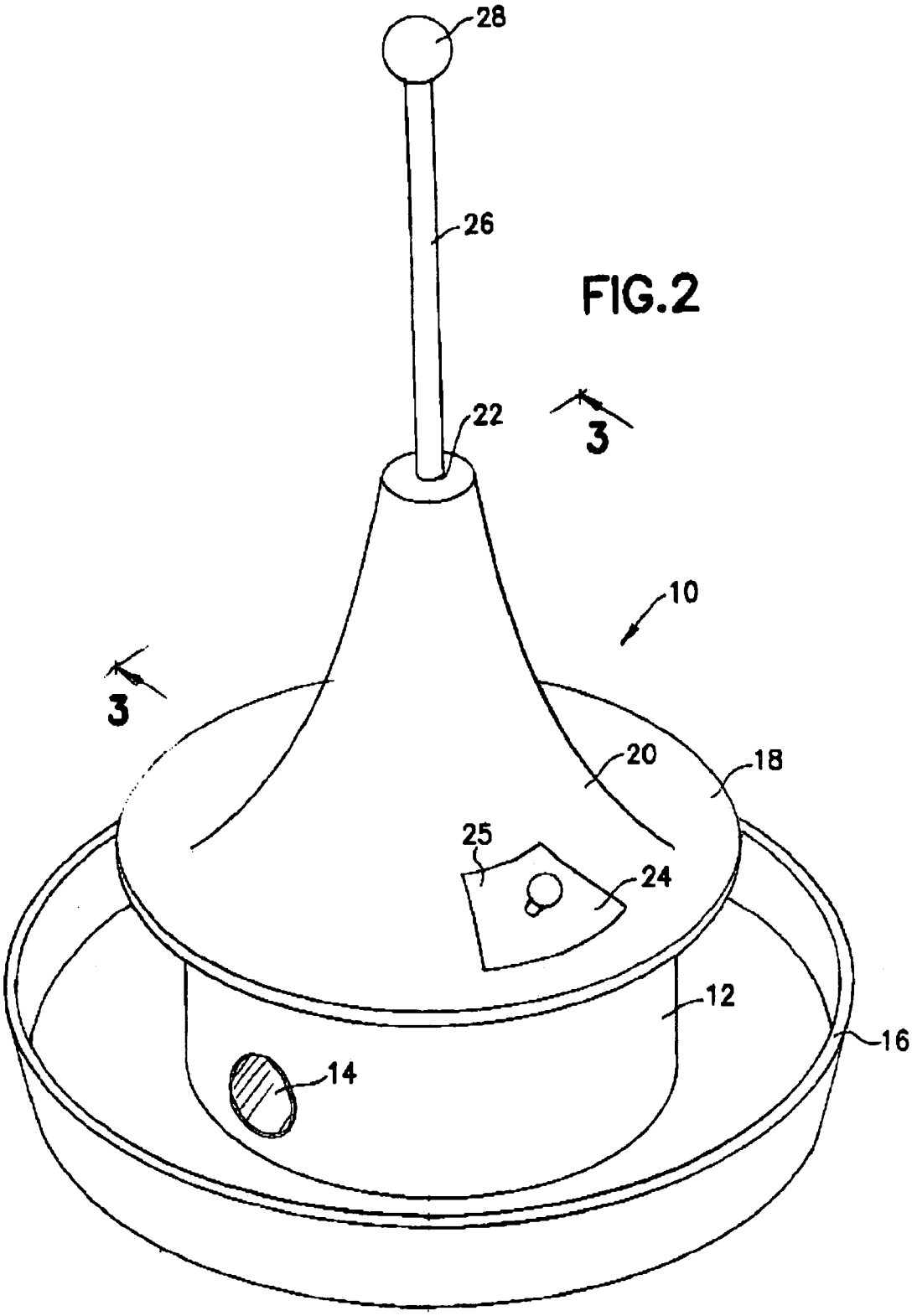
FIG. 2 is a perspective view of a preferred embodiment of the dispenser of this invention.
Figure 3:
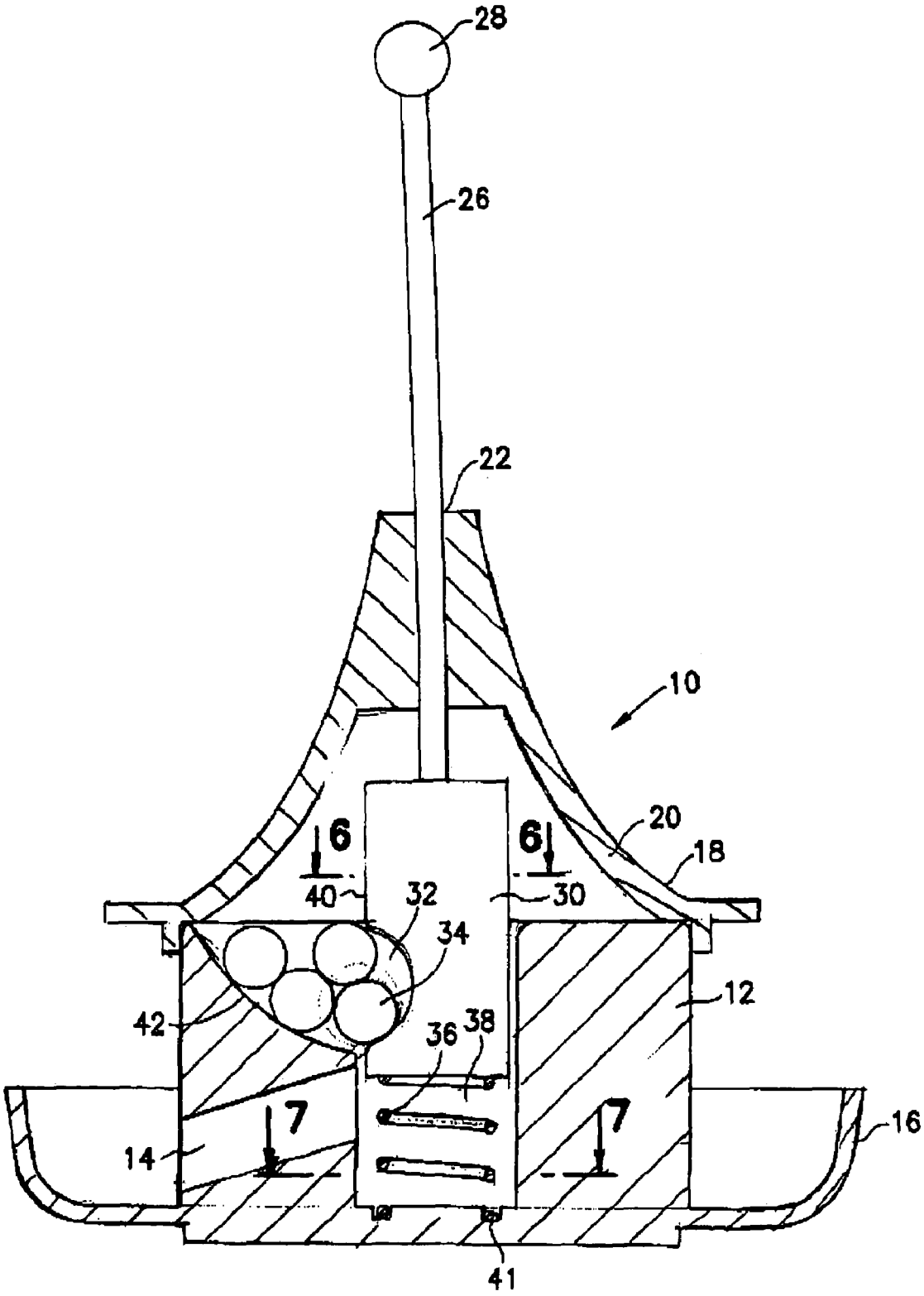
FIG. 3 is a cross-sectional view along the line 3—3 of FIG. 2 showing the dispenser in a non-dispensing mode.
Figure 4:
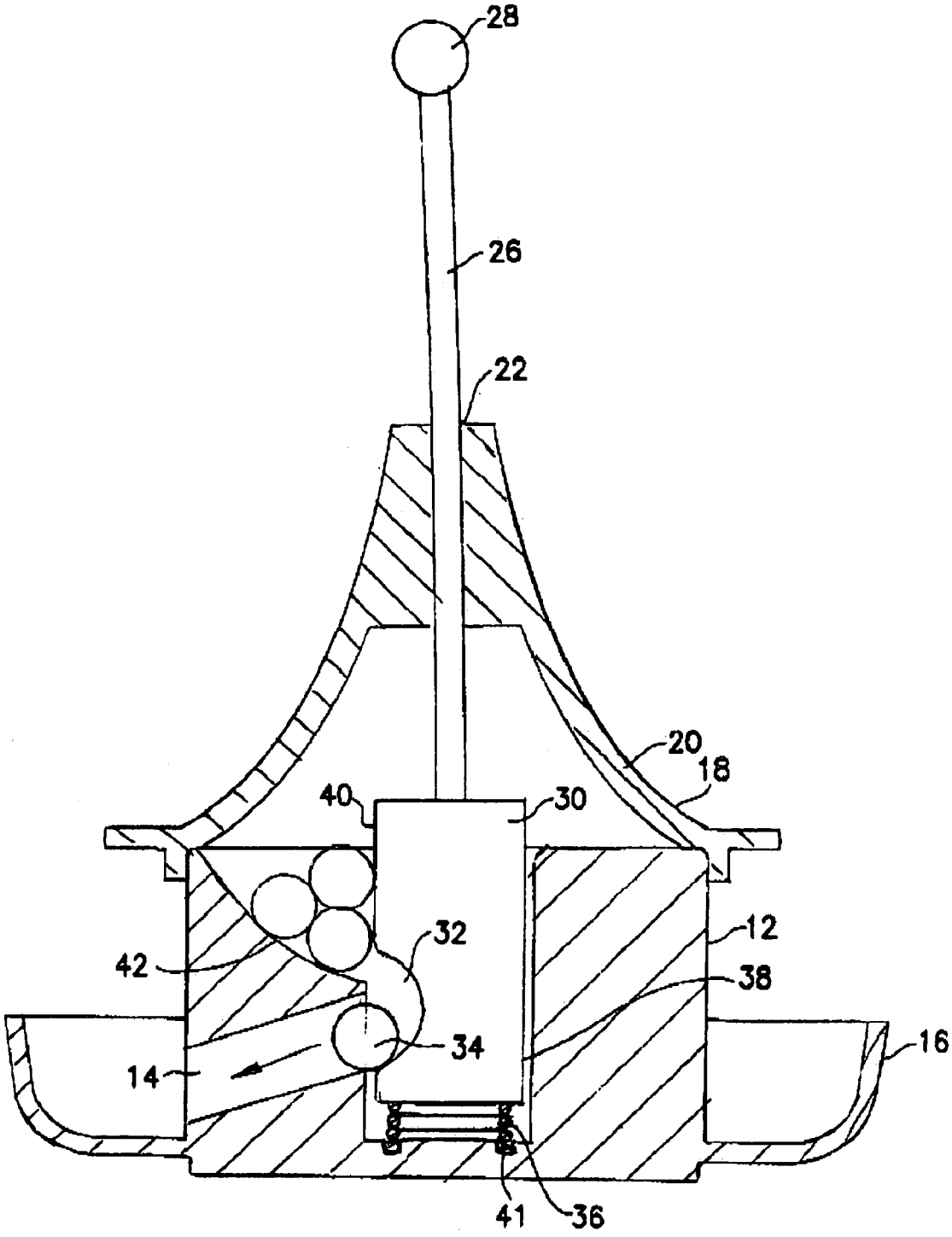
FIG. 4 is a cross-sectional view along the line 3—3 of FIG. 2 showing the dispenser in a dispensing mode.
Figure 5:
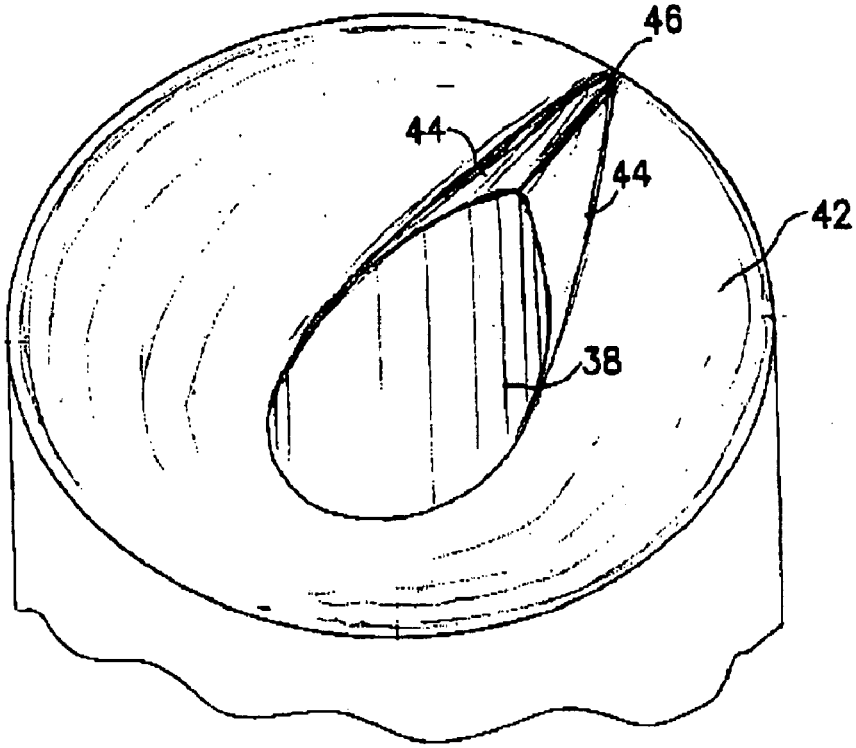
FIG. 5 is a perspective view of the top surface of the dispenser.

FIG. 2, illustrates an embodiment of the dispenser of the invention, generally designated as 10. Referring to FIG. 2, an upstanding annular wall 12 having a delivery chute 14 is disposed within a tray 16 for receiving the product egressing from the delivery chute 14. The upper end of the upstanding wall 12 defines a bowl-shaped portion 44, shown best in FIG. 5, and described in detail hereafter. Setting atop the upstanding wall 12 is a lid 18 having an upswept, conical-like portion 20 terminating in an opening 22, said opening passing vertically through the lid 18. Disposed on the lower portion of the lid 18 is an opening 24 having a removable lid 25 for filling the bowl-shaped upper surface with discrete gravity-flowable objects, such as for example, spherical-shaped candy. A retractable rod 26 having a knob 28 is placed within the opening 22. Shown best in FIGS. 3 and 4 is that the rod 26 is connected at its lower end with a plunger 30 and spring 36 mechanism that allows the rod 26 and plunger 30 to be depressed and returned to its non-depressed position. As explained in detail hereafter, it is the depression of the rod/plunger that effects a capture of one of the spherically-shaped candies and the transport of the captured candy to the chute 14 and consequent delivery of the candy to the tray 16.

In FIGS. 3 and 4, the part numbers set forth in FIG. 2 are for the same parts in FIGS. 3 and 4. Additionally, in FIGS. 3 and 4, there is an opening 38, which opening is non-circular in shape. Disposed in the opening 38 and attached to the bottom of the rod 26 is a plunger 30, the outer surface of said plunger 30 being non-circular in shape but shaped to vertically reciprocate in the opening 38 but not to rotate within the opening 38. In the side wall of the plunger 30 is a cup-shaped recess 32 for receiving a spherical candy 34. Disposed beneath the plunger 30 is a spring 36.

Figure 7:
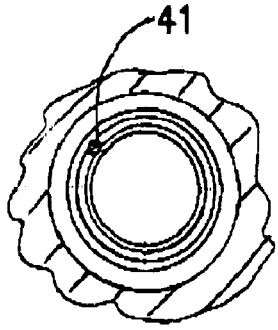
FIG. 7 is a plan view along the line 7—7 of FIG. 3.

Also shown in FIGS. 3, 4 and 7 is an annular groove 41 in the bottom of the opening 38. The annular groove 41 is configured to receive and assist in the upright stance of the spring 36.

Figure 6:
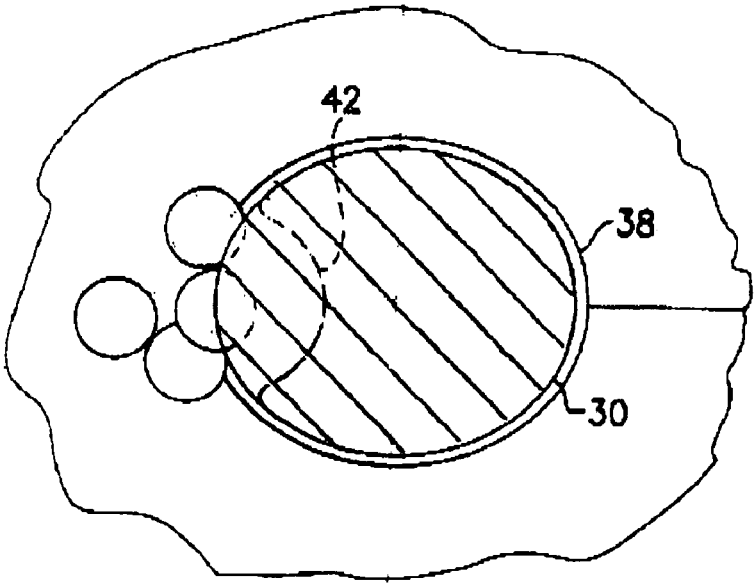
FIG. 6 is an enlarged partial cross-section along the line 6—6 of FIG. 3.

FIG. 6 shows the contour of the upper surface 42. Much of the upper surface 42 is of a bowl-like shape, however, on the side of the upper surface 30 opposite to the inboard opening of the chute 14, the upper surface 30 assumes a contour having an upward sweep on both sides of an apex 46.

The function of the upward sweep is to assure that all the spherical objects on the upper surface will move toward the recess in the side wall of the plunger and not be stored against the side wall of the plunger away from access to the recess in the side wall of the plunger. FIG. 6 shows a plan view of the opening 38 and the plunger 30 and the recess 32 in the plunger 30 represented by the dotted line 48.

In operation, the dispenser in the non-dispensing position (FIG. 3), a spherical candy will enter the recess in the side wall of the plunger. Depressing the rod will move the plunger downwardly and thereby bring the recess in the plunger carrying the spherical candy into registry with the inboard opening of the chute (FIG. 4) and cause the candy to enter the chute and pass to the tray situated below the outboard opening of the chute. Removing manual pressure on the rod will return the rod and plunger, through expansion of the spring, to the non-dispensing position of FIG. 3. Repeated depression and return of the rod and plunger will eventually discharge all of the candies that are stored in the bowl-like upper surface.

A modification of the afore-described broad aspect of the invention, the upstanding wall is positioned atop a series of posts, which posts define a plurality of ports through which the objects to be dispensed may pass after exiting from the recess in the side of the plunger.

For decorative and aesthetic purposes, a figurine such as, for example, a carousel horse, may be fixedly disposed atop the upstanding post on the lid. In the event of including a figurine in the assemblage of the dispenser, the rod passes through an opening in the figurine and then through the opening in the lid.

If desired, the dispenser may contain music playing capability. For example, a hand-crank system known to those skilled in the art may be incorporated into the base of the candy dispenser arranged such that the music commences upon each downward thrust of the plunger.

It has been found that a dispenser having the following dimensions functions as a satisfactory dispenser for spherical candies such as, for example, hard candy known as gum balls.

| | |
|---|---|
| Tray: | |
| Diameter of tray | 8.0 inches |
| Height of tray | 1.25 inches |
| Outside diameter of upstanding wall | 5.0 inches |
| Height of upstanding wall | 3.25 inches |
| Length of non-circular opening | 1.75 inches |
| Width of non-circular opening | 1.5 inches |
| Degree of taper to apex | |
| Apex of top surface of bowl shaped portion (same height as terminus of upstanding annular wall) | |
| Diameter of chute | 1.0 inches |
| Distance of outboard opening of chute from bottom of upstanding annular wall | 0.25 inches |
| Distance of inboard opening of chute from top terminus of upstanding annular wall | 1.0 inches |
| Plunger: | |
| Plunger perimetal shape | ovoid |
| Length | 1.375 inches |
| Width | 1.25 inches |
| Side recess - oval shape: | |
| Longest length | 1.25 inches |
| Widest width | 1.0 inches |
| Spring: | |
| Uncompressed length | 3.875 inches |
| Diameter of windings | 0.875 inches |
| Number of windings | 15 |
| Space between each of windings 2–14 | 0.25 inches |
| Diameter of wire | |
| Lid: | |
| Diameter annular lip extending from base of lid | 5.625 inches |
| Diameter of top surface of lid | 6.625 inches |
| Height from perimetal edge of lid to opening 22 | 2.5 inches |
| Figurine: | |
| Height of body of carousel horse | 2.0 inches |
| Length of carousel horse | across diameter of lid |
| Rod With Knob: | |
| Length of rod and knob | 8.0 inches |
| Filling Port in Lid | |
| Shape | trapezoidal |
| Length of top opening | 1.3125 inches |
| Length of bottom opening | 2.0 inches |
| Length of side opening | 1.125 inches |

The tray, annular upstanding wall, bowl-shaped top surface and the lid are molded using a porcelain ceramic. The figurine may likewise be molded of the same material. As a substitute material, the dispenser may be molded of polypropylene.

Modifications and alternative embodiments of the invention will be apparent to those skilled in the art in view of the foregoing description. This description is to be construed as illustrative only, and is, for the purpose of teaching those skilled in the art the best mode of carrying out the invention. The details of the structure, and method may be varied substantially without departing from the spirit of the invention, and the exclusive use of all modifications which come within the scope of the appended claims is reserved.

We claim:

1. A dispenser for gravity-flowable discrete objects comprising an upstanding wall, a storage compartment defined by the upstanding wall and a funnel-shaped wall extending from the interior of the upstanding wall across the opening defined by the upstanding wall to a second opening, said second opening extending at one end from the storage compartment and at its other end with the exterior of the dispenser, and a plunger having an attached handle extending from the top of the plunger is disposed in a vertically reciprocating relationship with the wall of the second opening, said plunger being solid and having one or more recesses in its side wall suitable for receiving the gravity-flowable discrete objects to be dispensed.

2. The dispenser of claim 1, and further wherein the base of the upstanding wall comprises a plurality of posts which define openings for the gravity-flowable discrete objects to emerge beyond the periphery of the dispenser.

* * * * *